US005964635A

United States Patent [19]

Krog

[11] Patent Number: 5,964,635

[45] Date of Patent: Oct. 12, 1999

[54] TOY CONSTRUCTION SYSTEM

[75] Inventor: Ricco Reinholdt Krog, Vejen, Denmark

[73] Assignee: INTERLEGO AG, Baar, Switzerland

[21] Appl. No.: 09/040,730

[22] Filed: Mar. 18, 1998

[51] Int. Cl.[6] ..... A63H 33/04

[52] U.S. Cl. ..... 446/120; 446/116; 446/122

[58] Field of Search ..... 446/116, 120, 446/121, 122, 124, 127; 403/4, 310, 360, 375

[56] References Cited

U.S. PATENT DOCUMENTS

| | | | |
|---|---|---|---|
| 278,224 | 5/1883 | Crandall | 446/124 |
| 2,885,822 | 5/1959 | Onanian | 446/122 |
| 3,528,192 | 9/1970 | Meates | 446/124 |
| 3,827,177 | 8/1974 | Wengel | 446/116 |
| 4,037,978 | 7/1977 | Connelly | 446/116 |
| 4,738,648 | 4/1988 | Berndt | 446/120 |
| 5,061,219 | 10/1991 | Glickman | 446/126 |
| 5,518,434 | 5/1996 | Zeigler | 446/121 |
| 5,704,186 | 1/1998 | Alcalay et al. | 52/726.1 |
| 5,823,843 | 10/1998 | Pohlman | 446/120 |

FOREIGN PATENT DOCUMENTS

| | | | |
|---|---|---|---|
| 377258 | 6/1964 | Switzerland | 446/116 |

*Primary Examiner*—Robert A. Hafer
*Assistant Examiner*—Jeffrey D. Carlson
*Attorney, Agent, or Firm*—Kane, Dalsimer, Sullivan, Kurucz, Levy, Eisele and Richard, LLP

[57] ABSTRACT

The present invention relates to a toy construction system comprising building elements of a first type that has a pair of opposed walls that define a space between said opposed walls, wherein those sides of the walls that face towards the space are provided with protruding ribs, and building elements of a second type that have a coupling head which may, by a snap-effect with protruding ribs, be received and releasably secured in the space between the walls on a building element of the first type, wherein said system further comprises building elements of a third type with coupling studs, wherein building elements of the first type or the second type have a cavity for releasably receiving and securing coupling studs on building elements of the third type.

6 Claims, 5 Drawing Sheets

TOY CONSTRUCTION SYSTEM

BACKGROUND OF THE INVENTION

1. Field of the Invention

The invention relates to a toy construction system that comprises two types of building elements. Building elements of the first type have a pair of opposed walls that define a space, wherein the space has, at free edges of the opposed walls, an open end and an open side, and wherein the walls have, on the sides facing the space, protruding ribs. Building elements of the second type have a coupling head that may, by a snap-fit effect with protruding ribs, be received and releasably secured in the space between the walls on a building element of the first type.

In such toy construction system, toy building elements of the one type can be structural elements, whereas building elements of the other of said types can be connectors for connecting two or more structural elements. The connectors may have relatively small dimensions whereas the structural elements have relatively large dimensions. The structural elements may be straight or arched bars of different lengths, or they may define or expand large or small surfaces that are used for imparting its structure to the construction built. Such toy construction system allows for easy and expedient building of large constructions.

2. Description of the Related Art

U.S. Pat. No. 5,061,219 teaches a toy construction system of the type described herein, and U.S. Pat. No. 4,044,097 discloses a similar toy construction system. Both of these systems feature elongate, bar-shaped structural elements, and the latter patent also features arched structural elements, and in addition to the structural elements, both publications also describe connectors used for connecting two or more structural elements. In these known systems the connectors serve as nodal elements.

These known toy construction systems allow for easy and expedient building of large and quite crude constructions that are comparatively voluminous but do not feature particularly many details.

With the invention a toy construction system of the type described herein is accomplished wherein it is possible to supplement with other types of building elements that enable new building options, and a large construction with great attention to detail can be obtained.

BRIEF DESCRIPTION OF THE DRAWINGS

In the following, the invention is explained with reference to the drawings, wherein.

DETAILED DESCRIPTION OF THE PREFERRED EMBODIMENTS

Figure 1:
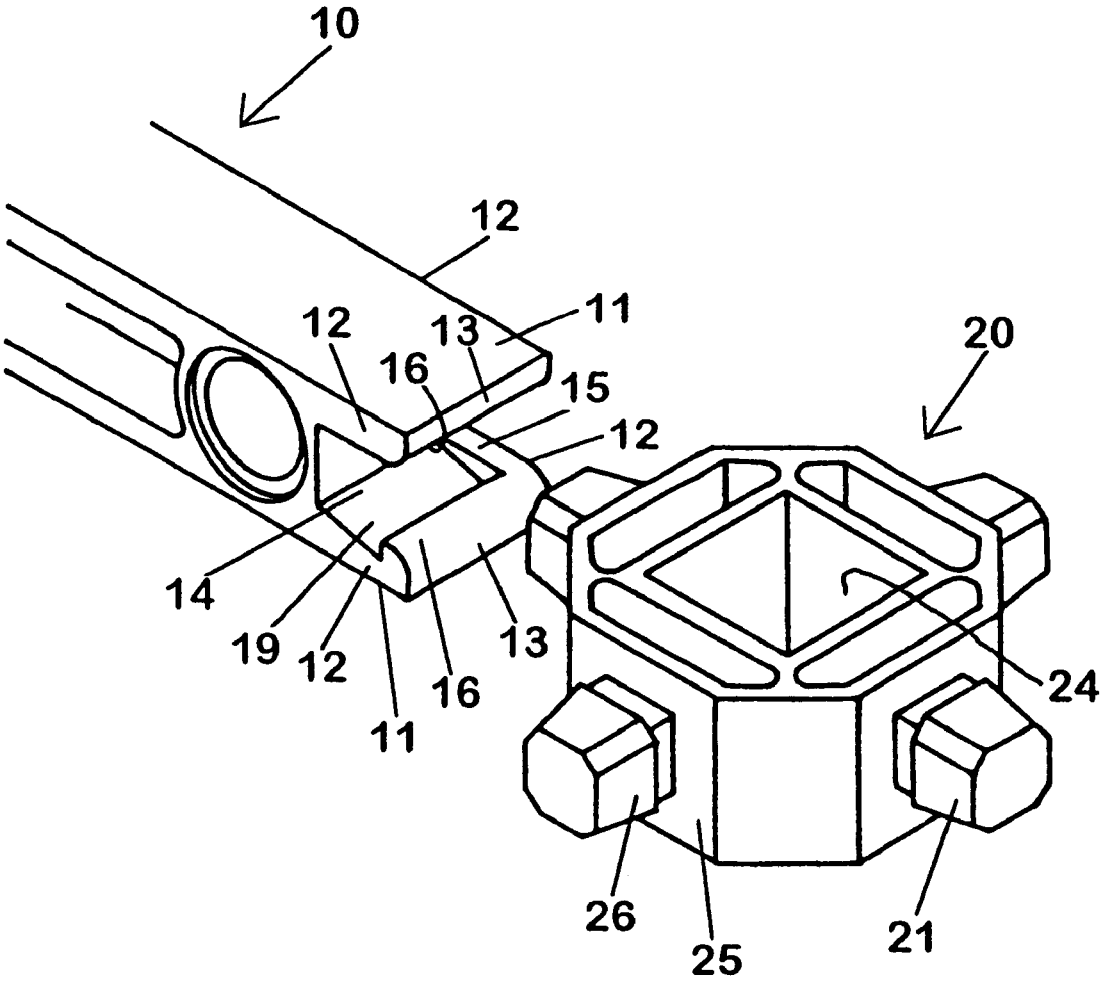
FIG. 1 is a perspective view of a building element of a first type and a building element of a second type.

FIGS. 1–9 illustrate an end portion of a building element 10 of a first type that is made of plastics. The building element 10 of the first type is elongate and has a substantially square outer configuration. In the end shown the building element 10 has a pair of protruding walls or arms 11 that are identical. Each of the walls 11 has two free, longitudinally extending edges 12 that are parallel with the longitudinal direction of the building element 10, and a free, transversally extending end edge 13 that is perpendicular to the longitudinal direction. Between the walls 11 is a space 14 with two open sides at the longitudinally extending edges 12, and an open end at the transversally extending edges 13. On those sides of each of the walls or the arms 11 that face towards the space 14, a longitudinally extending rib 15 is provided at the one of the two longitudinally extending edges 12, and a transversally extending rib 16 along the end edge 13.

FIGS. 1–9 also illustrate a building element 20 of a second type that is also made of plastics. The building element of the second type has a base portion with an outer wall of a generally octagonal shape, as will appear most clearly from FIGS. 2 and 4. Centrally in the base portion, a square, through-going opening 24 is provided that allows a building element 20 of the first type to pass through said opening. The outer wall of the building element 20 has four square faces 25, and centrally on each of the square faces 25, a coupling head 21 protrudes. The four coupling heads are identical, and each coupling head consists of a frustum of a pyramid 22 on a shank or a neck 23 with a square cross section. The frustums of a pyramid 22 are identical and have an octagonal cross section with four large faces 26 and four small faces 28.

Figure 2:
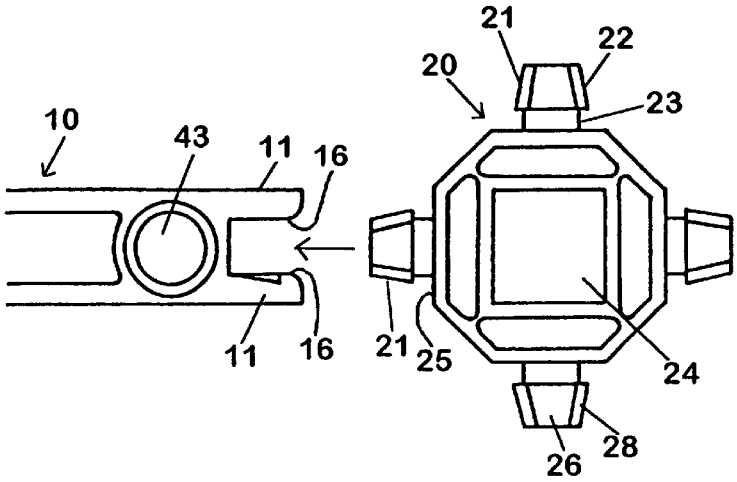
FIG. 2 illustrates the building elements shown in FIG. 1 when interconnecting in the axial direction.
Figure 3:
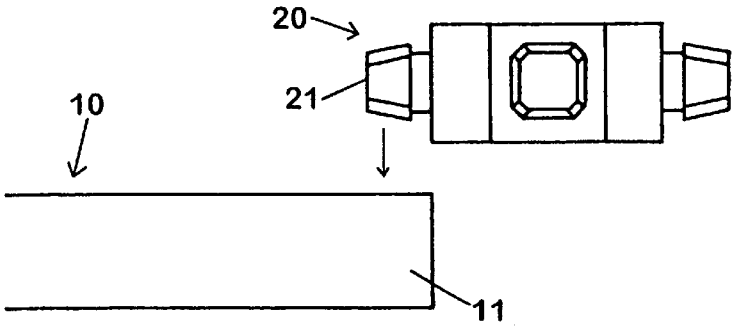
FIG. 3 illustrates the building elements shown in FIG. 1 when interconnecting in the lateral direction.

FIGS. 2–3 illustrate two different ways of combining a building element 10 of the first type with a building element 20 of the second type. In both cases a coupling head 21 is introduced onto the building element 20 between the walls 11 on the building element 10 as shown, in the directions of the arrows. The walls are resilient and may be flexed outwards.

Figure 4:
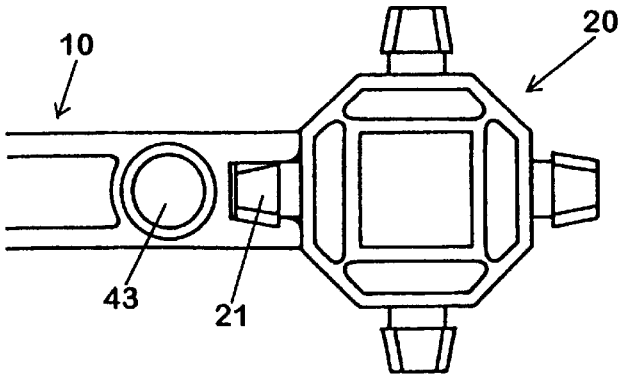
FIGS. 4 and 5 illustrate the building elements shown in FIGS. 1–3 in their assembled state and seen in two different views.
Figure 5:
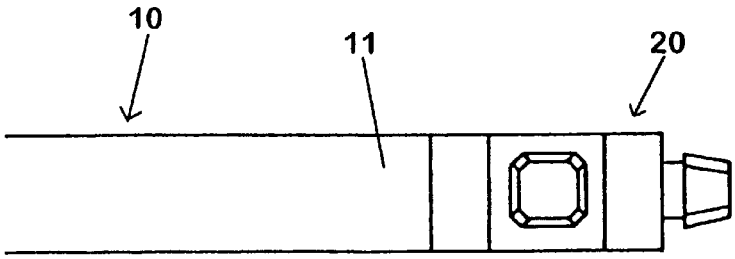

FIG. 2 illustrates the building element 10 and the building element 20 when interconnecting in an end-to-end relationship in the longitudinal direction of the building element 10. In the following, this direction is designated the axial direction. Interconnecting in the axial direction will cause two opposed large faces 26 on the coupling 21 to first come into contact with the two transversal ribs 16 at the free ends of arms 11 on the building element 10. By pressing the two building elements 10 and 20 further together in the axial direction, the large inclined faces 26 on the coupling head 21 that touch the ribs 16 on the building element 10 will force the arms 11 with the ribs apart, thereby enabling the coupling head 21 to be introduced between the ribs 16. When the entire frustum of a pyramid 22 has hereby been conveyed past the ribs 16, the elasticity of the arms 11 will cause them to move back to their starting position. Hereby a snap-fit effect will cause the ribs 16 to enter behind the frustum of a pyramid and keep the building elements 10 and 20 together in the axial direction. FIGS. 4–5 show the building elements 10 and 20 in this situation.

FIG. 3 illustrates the building element 10 and the building element 20 when interconnecting from the side or transversally to the longitudinal direction of the building element 10. In the following, this direction will be designated lateral direction. Joining in the lateral direction entails that the two small faces 28 on the coupling head 21 will first touch the longitudinally extending rib 15 on the one of the arms 11 and the longitudinal edge on the building element 10. By pressing the two building elements 10 and 20 further together in the lateral direction, the small inclined faces 28 on the coupling head 21 will, in the same manner as in case of joining in the axial direction, force the arms 11 apart, and hereby the coupling head 21 can be conveyed in between the arms 11. When the entire frustum of a pyramid 22 has thus been conveyed past the rib 15, the elasticity of the arms 11 will cause them to move back to their initial position. Hereby a snap-fit effect will cause the entire frustum of a pyramid to enter behind the ribs 15 that will keep the building elements 10 and 20 together in the lateral direction. FIGS. 4–5 show the building elements 10 and 20 in this situation.

Figure 9:
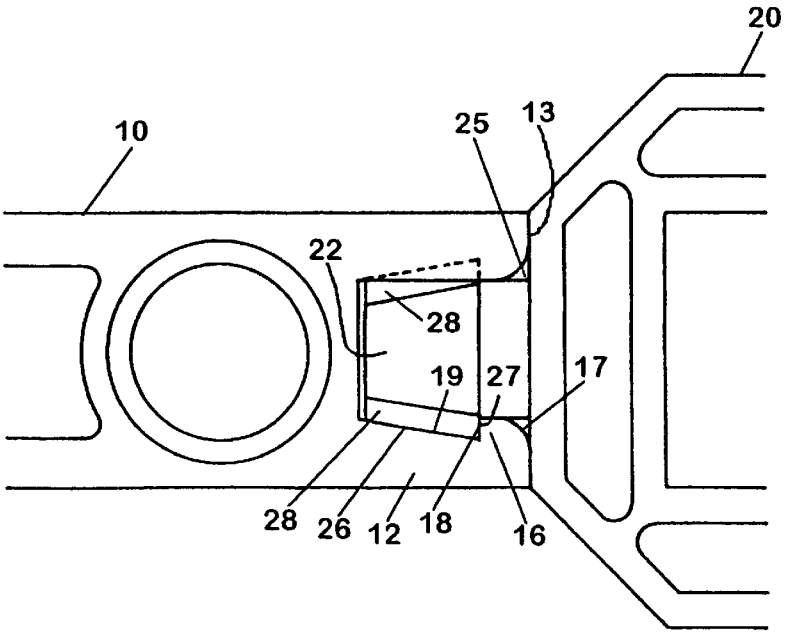
FIG. 9 is a large-scale view of the building elements shown in FIG. 4.

FIGS. 4–5 and 9 show the building elements 10 and 20 in their interconnected state. Whether the joining has been effected axially like in FIG. 2 or laterally like in FIG. 3, the same state is obtained as shown in FIGS. 4–5 and 9, where the frustum of the pyramid 22 is in contact with two longitudinally extending ribs 15 on each their wall 11, the two transversal ribs 16 also on each their wall 11, and finally also abuts on those sides 19 of the walls 11 that face towards the space 14. These sides of the walls 11 are inclined relative to the longitudinal direction of the building element 10 and has an inclination that corresponds to the inclination of the large faces 26 of the frustum of a pyramid 22, thereby establishing surface contact in their interconnected state. Finally, there is, in the interconnected state, contact between the transversal end edges 13 of the building element 10 and the square face 25 with the coupling head 21 on the building element 20. This ensures completely stable connection between the interconnected building elements 10 and 20.

FIG. 9 illustrates the interconnected building elements 10 and 20. It will appear that the transversal rib 16 at the outer edge 13 of the building element 10 has a rounded outer edge or front edge 17 and an inner edge or rear edge 18 which is substantially perpendicular to the longitudinal direction of the building element 10. It will also appear that, in addition to the inclined face 26, the frustum of a pyramid 22 of the coupling head has a rear edge that constitutes the large base area of the frustum and that is substantially perpendicular to the longitudinal direction of the building element 10. Joining in the axial direction like in FIG. 2 will mean that the inclined face 26 first touches the front edge 17 of the rib 16, and owing to the angulations of these faces relative to the longitudinal direction of the building element 10, joining of the building elements as described above is readily accomplished.

In the interconnected state, the rear edge 17 of the rib 16 is in contact with the rear edge 27 of the frustum 22 of the coupling head. These two edges or faces are, as mentioned, substantially perpendicular to the longitudinal direction, and therefore they will act against separation by direct pulling in the axial direction. The outcome is a very stable joining that may absorb considerable pull forces, and stable constructions will therefore result.

In the axial direction the snap-mechanism is thus asymmetrical whereby easy joining in the axial direction is accomplished whereas separation in the axial direction is counter-acted.

Figure 6:
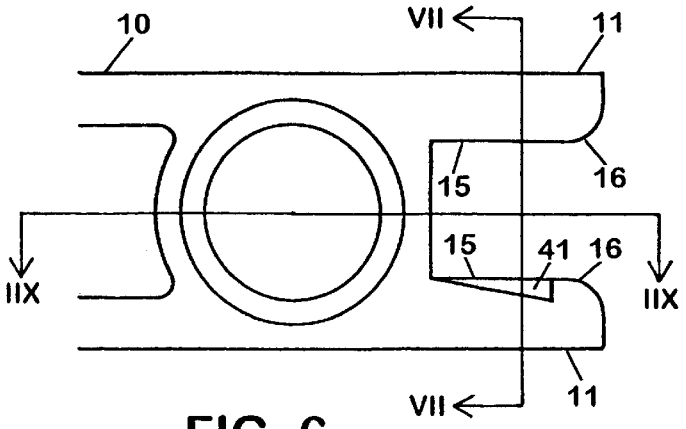
FIG. 6 illustrates an end portion of a building element of the first type.
Figure 7:
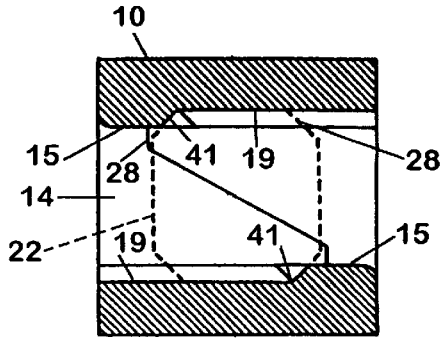
FIG. 7 is a sectional view of the building element shown in FIG. 6 along the line VII—VII.
Figure 8:
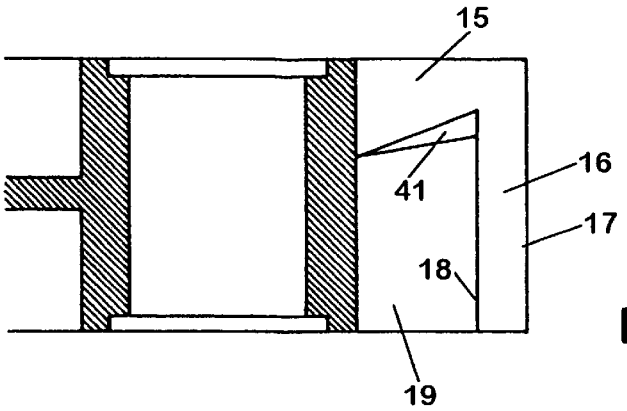
FIG. 8 is a sectional view of the building element shown in FIG. 6 along the line IXX—IXX.

FIGS. 7–8 are two different sectional views of the building element 10 shown in FIG. 6. In FIG. 7 a dotted line defines the outline of a frustum of a pyramid 22 to indicate the location of said frustum in the space 14 between the walls 11 in the assembled state. The small inclined faces 28 are in contact with the inclined inner faces 41 of the longitudinally extending ribs 15.

Separation of the combined building elements 10 and 20 can be accomplished in the lateral direction, i.e. in a direction opposite that of the assembly direction shown in FIG. 3. Hereby the small inclined faces 28 of the coupling head will press on the inclined inner faces 41 of the longitudinally extending 15 and hereby force the two walls 11 apart whereby they open and leave space for separating the building elements 10 and 20.

Separation of the combined building elements 10 and 20 can also be accomplished by tilting or capsizing the two building elements relative to each other around one of the end edges 13 on the arms 11. Hereby the coupling head will force the arms 11 apart, and the coupling head will be released from its engagement between the arms 11 and the ribs 16.

Finally, separation may also be accomplished by the building elements being rotated or twisted 45° relative to each other about the longitudinal axis. Since the width of the coupling head measured between two opposed, small, inclined faces 28 exceeds the width measured between two large, opposed faces 26, the arms 11 will also hereby be forced apart, and the coupling head may be released laterally.

Figure 10:
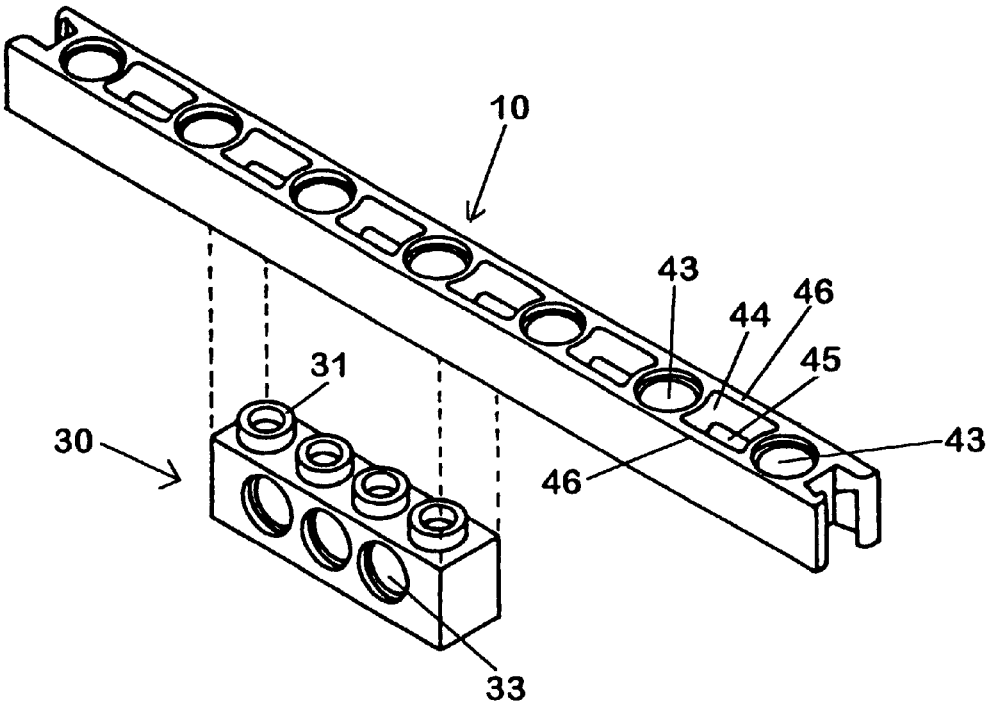
FIG. 10 illustrates a building element of the first type and a building element of the third type.

FIG. 10 illustrates a building element of the first type and a known building element 30 of a third type.

The building element 30 of the third type is known from toy building sets of the brand LEGO TECHNIC. On its top surface, the building element 30 has cylindrical protrusions or coupling studs 31 which in a manner known per se is used for interconnecting building elements of the third type by the coupling studs 31 being received in corresponding cavities in the undersides of the building elements where they frictionally engage with the insides of the walls. The building element 30 is provided with through-going cylindrical holes or openings 33 in their sides. At their ends, the holes 33 have a slightly expanded diameter.

The building element 10 is elongate and has a number of through-going holes 43 with the same configuration as the through-going holes 33 in the building element 30. Between each neighbouring pair of through-going holes 43, a cavity 44 is provided which is not through-going but has a bottom wall 45 situated centrally in the building element to which a H-profile is hereby imparted consisting of the two parallel opposed walls 46 and the bottom wall 45, as will appear most clearly from FIG. 13.

Figure 11:
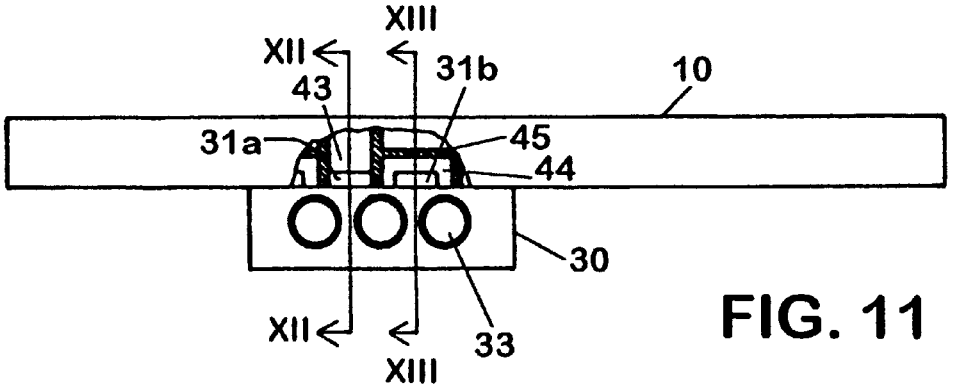
FIG. 11 illustrates the building elements shown in FIG. 10 in their interconnected state.
Figure 12:
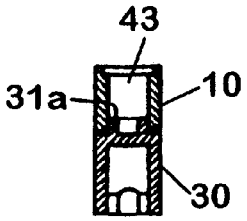
FIG. 12 is a sectional view through the building elements shown in FIG. 10 along the line XII—XII.
Figure 13:
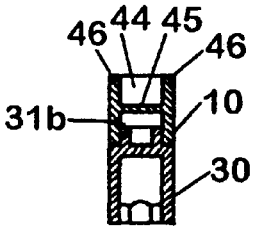
FIG. 13 is a sectional view through the building elements shown in FIG. 10 along the line XIII—XIII.

The holes 33 and 43 have a diameter corresponding to the diameter of the coupling studs 31, and the distance between two neighbouring holes 43 is exactly double the distance between two neighbouring coupling studs 31. Besides, the two parallel walls 46 have a distance that corresponds to the diameter of the coupling studs 31. Hereby the building elements 10 and 30 may be interconnected as shown in FIGS. 11–13 where the coupling studs 31 on the building element 30 is alternately received in through-going holes 43 and cavities 44. The diameter of the holes 43 and the distance between the walls 46 are so adapted that the coupling studs 31 can be received in the holes 43 or in the cavities 44 with a suitable friction, thereby allowing the building elements to be interconnected and separated by using a suitable force which is, in this context, designated coupling force. The coupling force entails that the building elements are secured relative to each other for later separation.

FIG. 11 illustrates the interconnected building elements 10 and 30 wherein the building element 10 is shown in a partially sectional view. It will appear from this figure as well as from FIG. 12 that a coupling stud 31*a* has been received in one of the through-going holes 43 where the inside of the hole encloses the coupling stud 31*a* in a frictional engagement. Furthermore, FIGS. 11 and 13 will show that a coupling stud 31*b* has been received in a cavity 44 where the coupling stud 31*b* touches the insides of the walls 46 in a frictional engagement.

Figure 14:
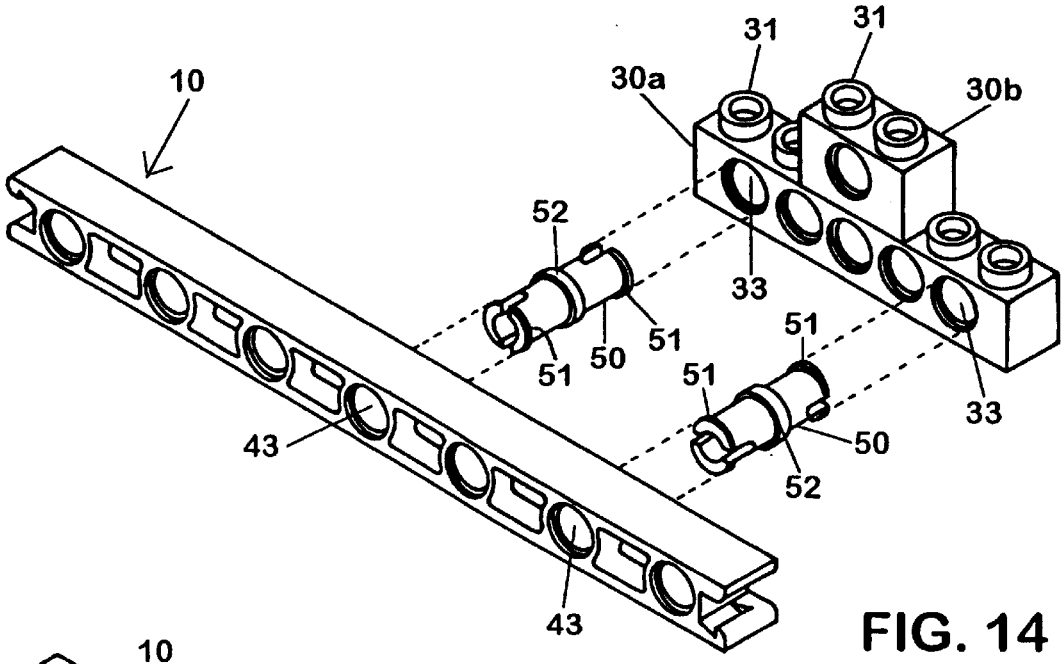
FIG. 14 illustrates a building element of the first type and two building elements of the third type.
Figure 15:
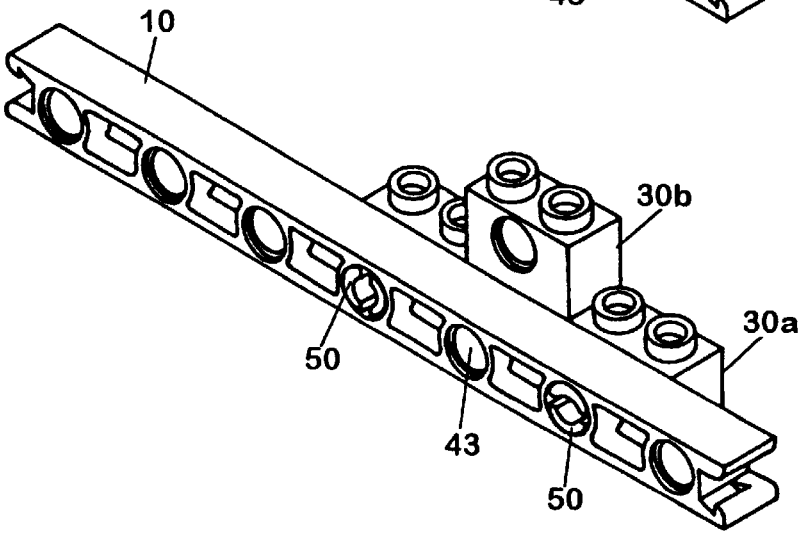
FIG. 15 illustrates the building elements shown in FIG. 14 when interconnected.
Figure 16:
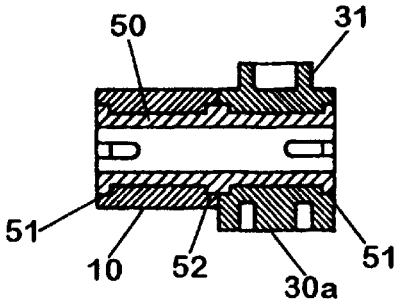
FIG. 16 is a sectional view through the combined building elements shown in FIG. 15.

FIGS. 14–16 show the building element 10 and two known building elements 30*a* and 30*b* of the same type as the building element 30 known from the toy building set of the brand LEGO TECHNIC. They also show two connectors 50 that are also known the toy building set of the brand LEGO TECHNIC. The connectors 50 are tubular and on their outsides, they are provided with a collar or a rib 51 at each end, and a flange 52 at the middle. The connectors 50 have been spliced at both ends to allow said ends to flex. Hereby the connectors may be inserted into the holes 33 in the building element 30*a*, since the collars 51 have a snap-effect. Thus, by means of connectors 50 two or more building elements of the third type can, in a manner known per se, be interconnected side by side since each connector engages a hole 33 in each of the building elements and thereby keep them together. The building elements are easily connected and disconnected.

The holes 43 in the building element 10 correspond to the holes 33 in the building element 30*a* and this enables the building elements 10 and 30*a* to be connected in a manner corresponding to the known connecting described above in connection with two building elements of the third type. This is shown in FIGS. 15 and 16 where FIG. 16 is a vertical sectional view through the interconnected building elements 10 and 30*a* and the connector 50 that keeps them together.

In FIG. 15 the building element 30*a* and 30*b* are merely representative of toy building sets of the brand LEGO TECHNIC whereby even very detailed and authentic toy models with many functional details can be constructed. Likewise, the building element 10 is also only representative of a toy building set comprising a large number of building elements of the first type and the second type.

Building elements of the first type and the second type can of course also be provided with coupling studs just like the building elements of the third type, whereby said building elements can be interconnected in the same manner as shown in FIGS. 10 and 11.

The connectors shown can also be permanently integrated parts of building elements of any of the three types shown. In that case the building elements will only include half a connector that protrudes from a surface of the building element.

In FIG. 15 the building element 10 and the building element 30*a* are interconnected by means of two connectors 50. Hereby a rigid connection between the interconnected building elements is accomplished. If, on the contrary, only one connector is used, interconnected building elements will be able to rotate or tilt relative to each other. Several interconnected building elements that constitute a partial construction wherein one or more connectors have a common axis may thus rotate or tilt relative to each other.

I claim:

1. A toy construction system comprising a set including building elements of a first type and building elements of a second type;

the building elements of the first type having a pair of opposed walls that define a space between said opposed walls, wherein those sides of the walls that face towards the space are provided with protruding ribs;

the building elements of the second type having a coupling head which may, by a snap-effect with the protruding ribs, be received and releasably secured in the space between the walls on a building element of the first type;

the toy construction system further comprising building elements of a third type with coupling studs;

wherein building elements of the set have an H-shaped cross-section defining opposed cavities for releasably receiving and securing coupling studs on building elements of the third type.

2. The toy construction system according to claim 1, further comprising building elements having cavities with an internal cylindrical face for frictionally receiving cylindrical coupling studs.

3. The toy construction system according to claim 2, wherein the cavities with cylindrical faces are through-going cylindrical openings.

4. The toy construction system according to claim 3, wherein the coupling studs are tubular and have a free end with an external rib for snap-fit with the ends of said cylindrical opening.

5. The toy construction system according to claim 3, further comprising tubular connectors that have two free ends with external ribs for snap-fit with the ends of the cylindrical openings.

6. The toy construction system according to claim 1, wherein some building elements belong to at least two of the types.

* * * * *